United States Patent [19]

Hugo et al.

[11] Patent Number: 4,871,124

[45] Date of Patent: Oct. 3, 1989

[54] METHOD OF WINDING FABRIC ONTO A CLOTH BEAM AND A TRANSPORTER THEREFOR

[75] Inventors: Schilling Hugo, Winterthur, Switzerland; Günter Veith, Münsingen-Dottingen, Fed. Rep. of Germany

[73] Assignee: Sulzer Brothers Limited, Winterthur, Switzerland

[21] Appl. No.: 206,196

[22] Filed: Jun. 13, 1988

[30] Foreign Application Priority Data

Jun. 16, 1987 [CH] Switzerland ..... 02270/87

[51] Int. Cl.[4] ..... B65H 18/08; B65H 19/20

[52] U.S. Cl. ..... 242/56 R; 242/66; 242/74

[58] Field of Search ..... 242/56, 56 A, 66

[56] References Cited

U.S. PATENT DOCUMENTS

| | | | |
|---|---|---|---|
| 2,950,873 | 8/1960 | Nelson | 242/56 A |
| 3,045,939 | 7/1962 | Vanderwall | 242/56 R |
| 3,944,149 | 3/1976 | Frezza | 242/56 R |
| 4,000,863 | 1/1977 | Straujups | 242/56 |
| 4,690,348 | 9/1987 | Watanabe et al. | 242/66 |

*Primary Examiner*—Stuart S. Levy
*Assistant Examiner*—John M. Eghtessad
*Attorney, Agent, or Firm*—Kenyon & Kenyon

[57] ABSTRACT

After the cloth beam has been removed from the weaving machine, the fabric is looped over an empty cloth beam in the transporter by a wind-on beam. The fabric is then cut by a cutter and pressed by a blade against the periphery of the empty cloth beam. The wind-on beam travels about the empty cloth beam to a position to permit the cloth beam to wind on the cloth while pressing the folded end of the fabric between the cloth beam and the first winding of fabric on the beam.

11 Claims, 8 Drawing Sheets

METHOD OF WINDING FABRIC ONTO A CLOTH BEAM AND A TRANSPORTER THEREFOR

This invention relates to a method of winding fabric onto a cloth beam and to a transporter for a weaving mill.

As is known, when a cloth beam is to be changed in a weaving, machine, it has been necessary to wind the fabric onto a new cloth beam since the fabric between the full cloth beam and the weaving machine must be cut if the cloth beam is to be removed from the weaving machine, for example, by a transporter.

Japanese Patent Application No. 61 023059 describes a method of winding fabric onto an empty cloth beam in which the free end of the web of fabric is brought into contact with the empty cloth beam by means of compressed air. At the same time, suction air flows into the cloth beam through boards therein in order to hold the free end of the fabric web against the cloth beam surface. However, in the case of relatively large fabric widths, this results in intensive air flows if air is to be ejected simultaneously from a relatively large number of nossles and air is to be drawn in through a large number of suction ports. In such cases, textile fibers may become entrained in the machine and may impair the quality of the fabric and operation of the machine. There is also no guaranty of the winding operation being successful with all types of fabric, particularly, smooth fabrics.

Accordingly, it is an object of the invention to effect the winding on of fabric onto an empty cloth beam without the use of compressed air or suction air.

It is another object of the invention to provide a high degree of operational reliability in the winding of cloth onto empty cloth beams during a cloth beam exchange in a weaving machine.

Briefly, the invention provides a method of winding fabric onto a cloth beam in a transporter for a weaving mill.

To this end, a free end of the fabric is placed over an empty cloth beam in the direction of rotation of a beam during a subsequent winding on process. In addition, a blade is placed tangentially of the empty cloth beam and against the free end of the fabric in order to hold the fabric against the cloth beam. Thereafter, a wind-on beam is moved about the cloth beam in order to wrap the cloth about the cloth beam and to position the blade between the beams with the free end of the fabric resting on the wind-on beam. Next, the cloth beam is rotated to wind the cloth thereon and over the free end of the fabric.

After the wind-on beam has moved around the fresh cloth beam, the cloth beam and winding-on beam are pressed against one another with the interposition of the blade and of the fabric for winding on. While the free end of the fabric is then folded in a form of a V, this form being formed internally by the blade and externally by the cloth beam and a wind-on beam, the fabric web passes tangentially at the free end of the blade from the wind-on beam to the fresh cloth beam.

Rotation of the fresh cloth beam in the direction of the free end of the blade causes the free end of the fabric to be placed tightly between the cloth beam and the first winding of cloth on the cloth beam. This provides a non-slip winding of the cut-off fabric on the fresh cloth beam.

Winding on of the fabric may also be performed without the V-fold if the free end of the folded blade rests practically in register with the free end of the fabric on a fresh cloth beam such that no folding occurs.

The invention also provides a transporter with a means for mounting an empty cloth beam on a predetermined axis and a pair of manipulators which are rotatably mounted on the same axis for receiving a wind-on beam on a second axis spaced from and parallel to the axis of the cloth beam. Each manipulator is rotatable above the axis of the mounted cloth beam in order to selectively move the wind-on beam about the cloth beam in order to perform the method described above.

Each manipulator includes a sun wheel which is fixably mounted on the axis of the mounted cloth beam and a drivable planetary wheel which meshes with the sun wheel in order to selectively move the wind-on beam about the cloth beam.

The blade for holding the free end of the cloth against the empty cloth beam may be constructed with individual segments which are longitudinally spaced apart and which are longitudinally movable relative to each other in order to adjust to the width of a mounted cloth beam.

The wind-on beam may also be made of telescopic construction to adapt to the width of a cloth beam. For example, the wind-on beam may include an inner tube, an outer tube telescopically receiving a portion of the inner tube and having an outside diameter greater than the inner tube and a plurality of tubular segments, each of which is slidably mounted on the inner tube and each of which has an outside diameter equal to the outside diameter of the outer tube. Further, the wind-on beam may be provided with an elastic plastics coating.

These and other objects and advantages of the invention will become more apparent from the following detailed description taken in conjunction with the accompanying drawings wherein:

FIG. 1. illustrates a prospective view of a transporter constructed in accordance with the invention;

FIG. 2. illustrates a front view of a transporter positioned adjacent to a weaving machine and a weaving mill in accordance with the invention;

FIG. 3*a* through 3*d* schematically illustrate the positions of a wind-on beam relative to an empty cloth beam during transfer of a fabric to the wind-on cloth beam in accordance with the invention;

FIG. 3*e* to 3*g* illustrate the relative positions of the wind-on beam and empty cloth beam for a wind-on of the cloth onto the cloth beam;

FIG. 3*h* illustrates a relative position of the wind-on beam and cloth beam after winding on of a cloth has started;

Figure 1:
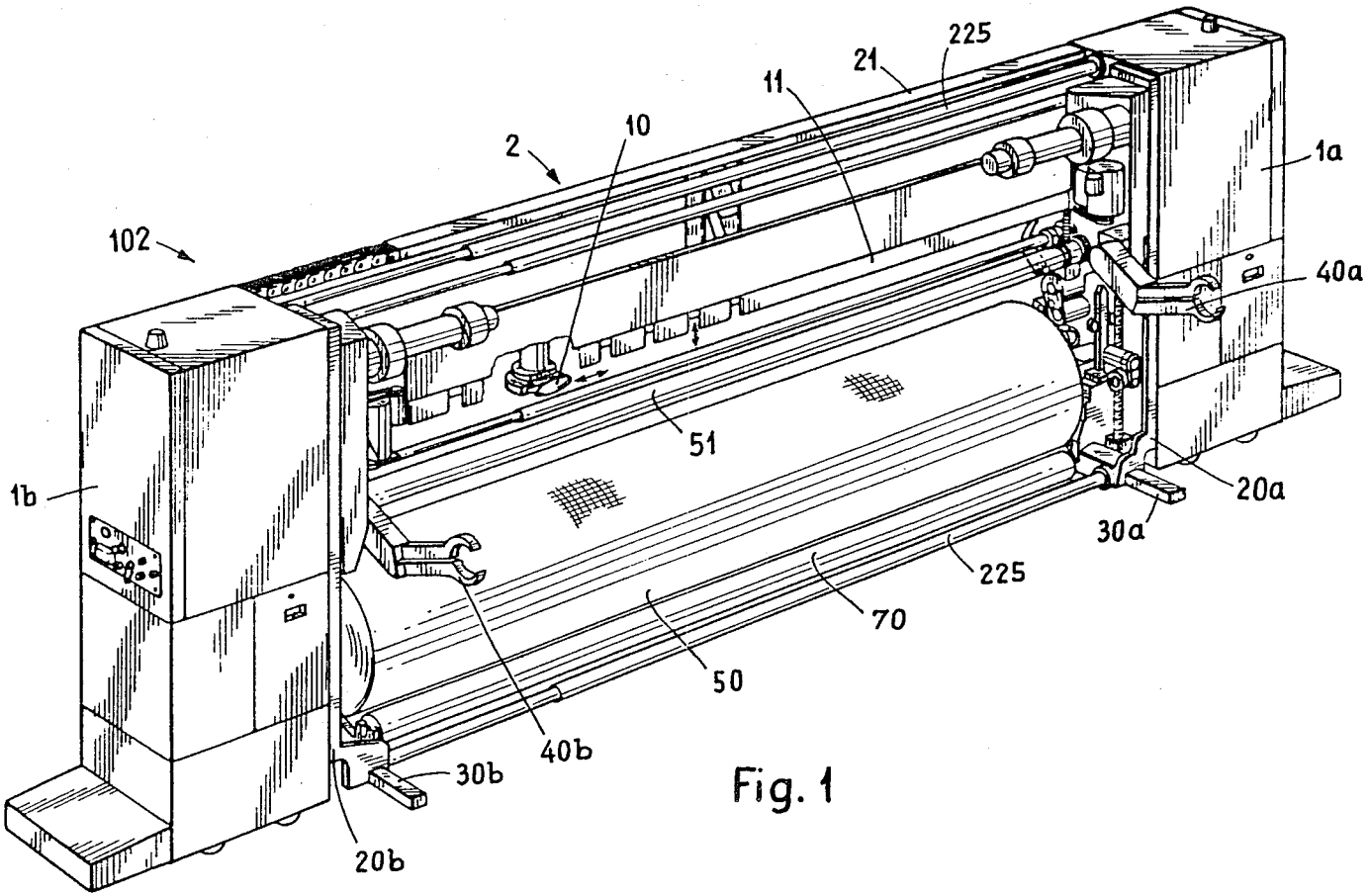

Referring to FIG. 1, of the transporter 102 is constructed of a pair of mobile units 1*a*, 1*b* and a carrier unit 2 which is positioned in the between and mobile units 1*a*, 1*b*. Each mobile unit 1*a*, 1*b* is supported on a plurality of rollers or wheels for movement along a floor of a weaving mill and each contains a propulsion unit (not shown) for moving the transporter 102 through the weaving mill along a track (not shown) in the floor of the weaving mill.

The carrier unit 2 is constructed of a pair of side parts 20*a*, 20*b* which are interconnected by a plurality of telescopic rods 225 by means of which the length of the transporter 102 can be adapted to the type of weaving machine to be serviced at any time. In addition, a cross-member 21 connects the side parts 20*a*, 20*b* together while being displaceable with respect to the left-hand side part 20*b*, as viewed.

The carrier unit also includes a pair of extensible supports 30*a*, 30*b* which are provided at the bottom of the side parts 20*a*, 20*b* to enable the carrier unit 2 to be supported on the floor of the weaving mill during the changing of a cloth beam.

The carrier unit 2 also includes a means for mounting a full cloth beam 50 thereon, means for mounting an empty cloth beam 51 about a first axis and means for mounting a wind-on beam 70 on a second axis. In addition, a pair of gripper arms 40*a*, 40*b* are mounted at opposite ends of the carrier unit 2 for the transfer of a beam from a weaving machine onto the carrier unit 2 and vice versa. Still further, a cutter 10 is mounted in the carrier unit 2 for longitudinal movement across the width of the cloth of a full cloth beam 50 in order to sever the cloth extending therefrom.

Figure 2:
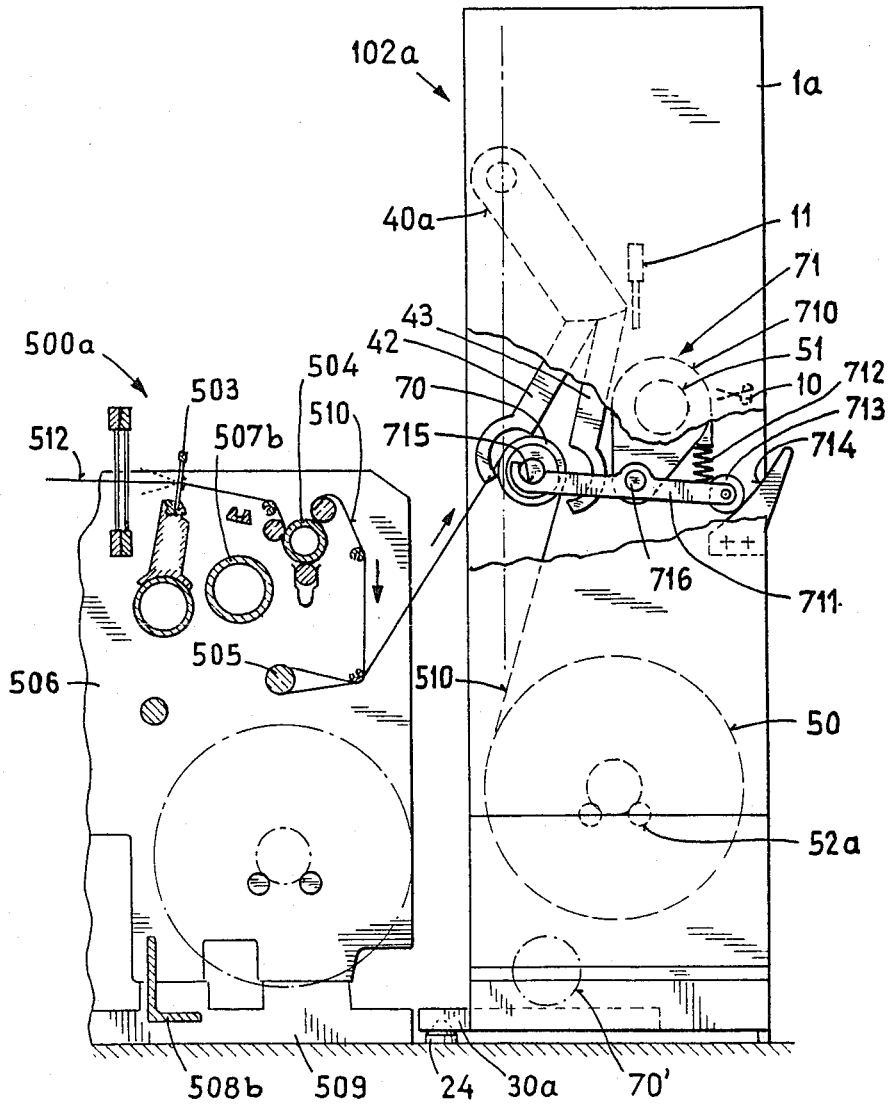

Referring to FIG. 2, the transporter 102 is illustrated in a position next to a weaving machine 500*a*. As indicated, the weaving machine 500*a* has warp yarns 512 fed to a sley 503 where picking takes place. The resultant fabric 510 is guided by way of a take-off motion 504 and guide rods 505 to the cloth beam 50 which is mounted within the weaving machine. The various weaving machine elements are mounted between side plates 506 which are interconnected by tubular cross-members 507*b* and angular cross-members 508*b* and supported on foot rails 509. The fabric 510 is wound onto the cloth beam 50 until the cloth reaches a maximun permissible diameter. When this has been reachead, a logistic control device in the weaving mill orders the transporter 102 to the weaving machine 500*a*.

FIG. 2 illustrates the position of the transporter 102 after removal of the full cloth beam 50 from the weaving machine and before the cloth is wound onto a fresh fabric beam 51. In this respect, the gripper arms 40*a*, 40*b*, each of which has a pair of relatively movable limbs 42, 43 has moved the full cloth beam out of the weaving machine from the broken-line position into a carrier device 52*a* in the transporter 102. In addition, the wind-on beam 70 has been lifted from the bottom position 70' and is just being released in the solid-line position by the gripper arms 40*a*, 40*b*. During the lifting of the wind-on beam 70, the fabric 510 forms a loop since the fabric has been pulled upwards with the wind-on beam.

As indicated in FIG. 2, the gripper arms 40*a*, 40*b* transport the wind-on beam 70 to a manipulator 71 at each end of the carrier unit. As schematically illustrated, each manipulator 71 has a housing 710 which is mounted for rotation about the axis of the empty cloth beam 51. In addition, a lever 711 is rotatably mounted on the housing 710 about a pivot 716 and is pressed downwardly and outwardly at the right-hand end by a compression spring 712 from the housing 710. A roller 713 is also mounted on the right-hand end of the lever 711 to run on a cam segment 714 fixed to the transporter upon rotation of the housing 710 in a clockwise direction. During clockwise rotation of the housing 710, the lever 711 is pivoted in a counter-clockwise direction about the pin 716 relative to the housing 710. Under these conditions, a recess 715 at the left-hand end of the lever 711 comes into a position to take over the wind-on beam 70.

A manipulator 71 is disposed on both sides 20*a*, 20*b* of the transporter 102; however, only one manipulator need be described.

After the wind-on beam 70 has been taken over by the manipulator 71, the beam 70 is rotated in a counter-clockwise direction about the axis of the cloth beam 51. As soon as the roller 713 disengages from the cam segment 714, the lever 711 is again moved in a clockwise direction under the force of the spring 712. As a result, the surface of the wind-on beam 70 abuts against the surface of the empty cloth beam 51. The wind-on beam 70 is then passed around the cloth beam 51 in the counter-clockwise direction by the manipulator.

Figure 3A:
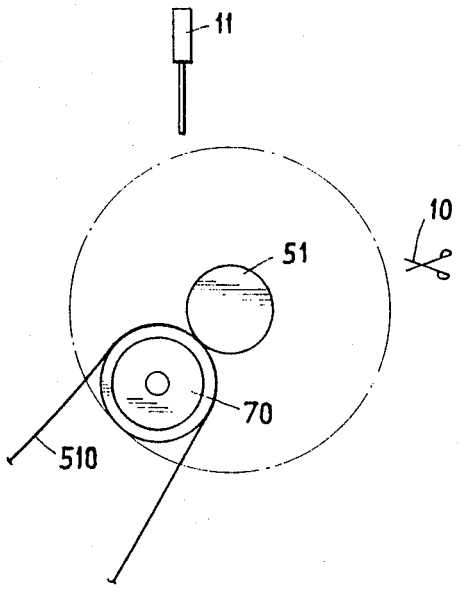
Figure 3B:
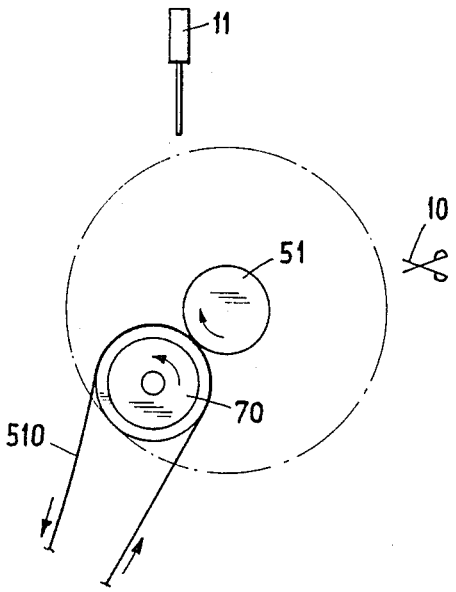
Figure 3C:
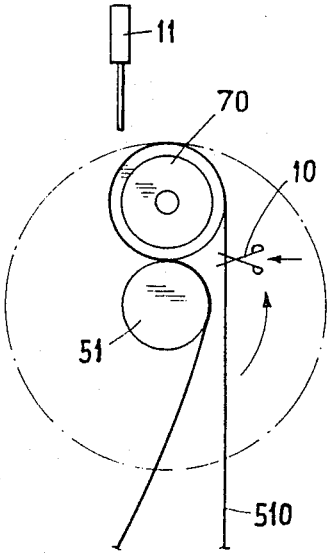

Referring to FIG. 3*a*, initially, the wind-on beam 70 is brought into contact with the empty cloth beam 51. Thereafter, the cloth beam 51 is briefly driven in the clockwise direction so that the wind-on beam forms a cloth reserve towards the weaving machine, as indicated by the arrows. In these conditions, the fabric required to form the cloth reserve is unwound from the full cloth beam 50 (not shown).

Figure 3D:
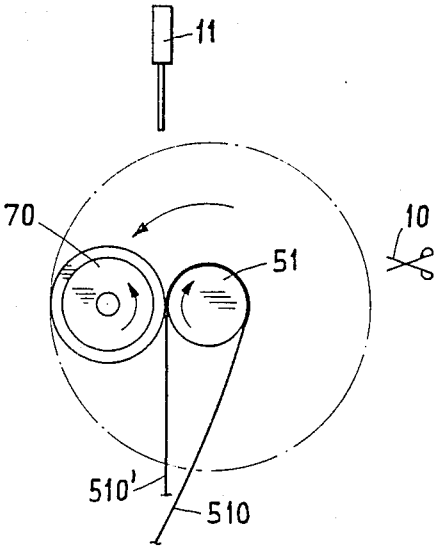

After the wind-on beam 70 has reached a position above the cloth beam 51, the cutter 10 is brought up to the fabric and severs the fabric. The cutter 10 is then moved back into its original position while the wind-on beam 70 moves further counter-clockwise into the position illustrated in FIG. 3*d*. The free end 510' of the fabric then falls down over the cloth beam 51. At this time, the cloth beam 51 rotates in the clockwise direction until a specific free length of the cloth hangs down from the cloth beam. During this time, the wind-on beam 70 is in contact with the cloth beam 51 so as to perform a counter-clockwise rotation.

Figure 3E:
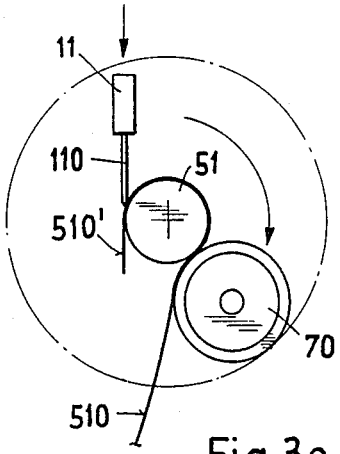

Referring to FIG. 3*e*, after the cloth beam 51 has stopped, the wind-on beam 70 is swung back in the clockwise direction as indicated by the arrow. During this time, the wind-on beam 70 rolls on the cloth beam 51. Thereafter, the folder 11 is moved down so that the free end of the folder blade 110 is placed tangentially of the cloth beam 51 and against the free end 510' of the fabric to hold the fabric against the cloth beam 51.

Figure 3F:
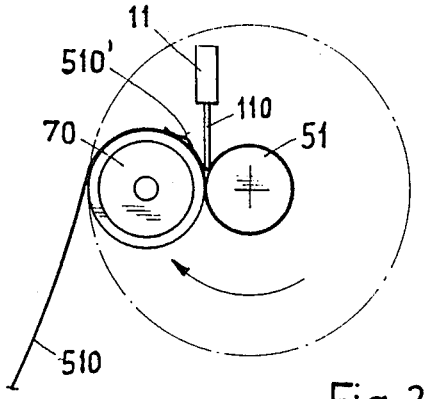
Figure 3F:
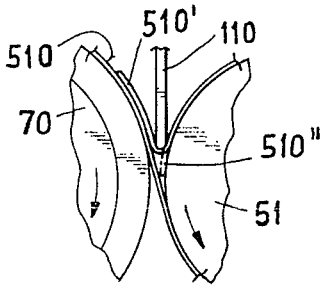

Referring to FIG. 3*f*, the wind-on beam 70 is swung further in the clockwise direction by means of the manipulator 71 (not shown) until touching the free end of the folder blade 110 on the side remote from the cloth beam. Under these conditions, the free end of the fabric and the fabric situated above the wind-on beam 70 are lifted until the free end of the fabric is folded into the form of a V between the cloth beam 51 and wind-on beam 70, on the one hand, and the blade 110, on the other hand. As indicated in FIG. 3*f*, the fabric 510 in the region of the end of the folder blade 110 passes tangentially from the wind-on beam 70 to the cloth beam 51. As also indicated, the end of the blade 110 is disposed near the nip formed between the beams 51, 70.

Winding-on of the fabric may also be possible when the free end of the fabric projects only a small amount beyond the free end of the folder blade 110.

Figure 3G:
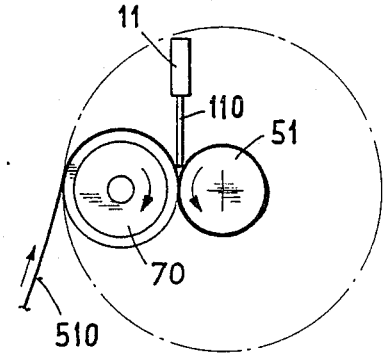
Figure 3G:
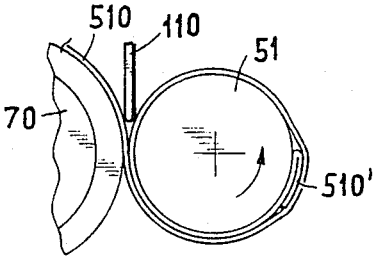

Referring to FIG. 3*g*, the cloth beam 51 is again activated to rotate in the counter-clockwise direction so as to begin winding-on of the cloth. The fabric 510 is thus drawn off the wind-on beam 70 and wound onto the cloth beam 51. During this time, the folded end of the fabric is pulled downwardly, as viewed, and pressed tightly between the surface of the cloth beam 51 and the first winding of fabric thereon without any slippage. Further rotation of the cloth beam 51 causes a number of layers of fabric to be wound thereon while the wind-on beam 70 and folder 11 remain in position.

Figure 3H:
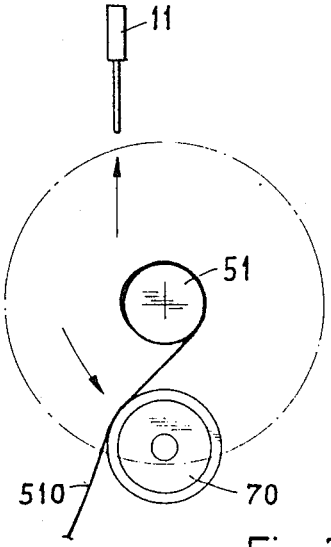

Referring to FIG. 3*h*, after the winding of the cloth beam 51 has been temporarily completed, the folder 11 is moved upwardly to the initial position thereof while the wind-on beam 70 is pivoted downwardly and disengaged from the wind-on beam 51. The cloth beam 51 can then be engaged by the gripper arms 40*a*, 40*b* and moved downwardly into the bearings in the weaving machine. During the lowering of the cloth beam 51 and the transporter 102, that part of the fabric between the weaving machine and the new cloth beam 51 which has been loosened is stretched taut in an intermediate position of the cloth beam. In this position, the cloth beam is driven briefly in the counter-clockwise direction. After the cloth beam has been inserted into the weaving machine, the gripper arms 40*a*, 40*b* (FIG. 2) move upwardly in the transporter 102 to engage the wind-on beam 70 to bring the beam 70 back into the original position 70' in the bottom part of the transporter.

Figure 4:
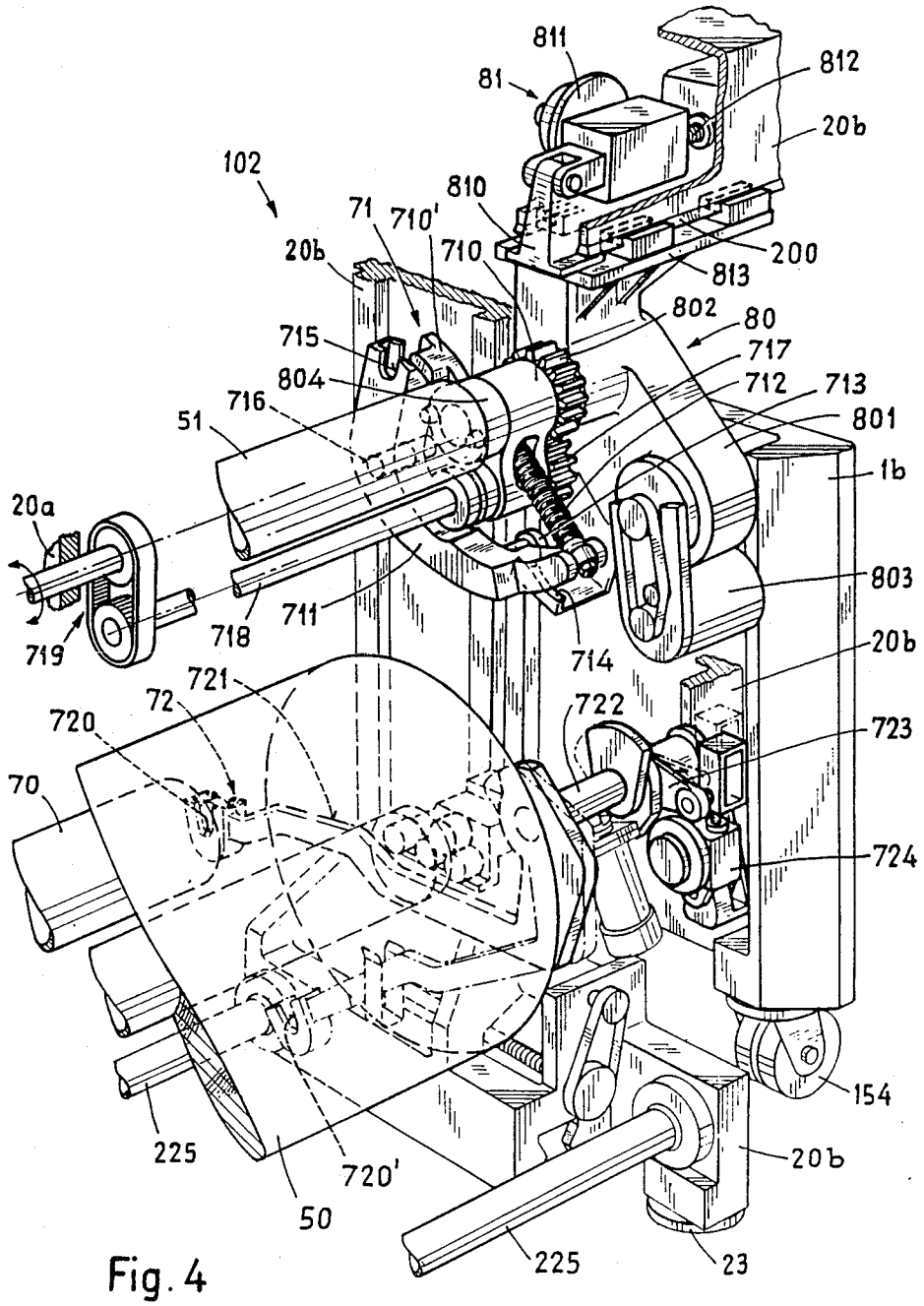
FIG. 4 illustrates a part perspective view of a manipulator for moving the wind-on beam relative to the empty cloth beam in accordance with the invention.

Referring to FIG. 4, wherein like reference characters indicate like parts as above, the manipulator 71 is more particularly illustrated. As indicated, an axial adjustment device 81 is mounted on the side part 20*b* of the carrier unit. This device 81 carries a manipulator 71 for the wind-on beam 70 and cloth beam 51. As indicated, the device 81 has a base plate 813 which is slidably mounted on dovetail guides 20 on the side part 20*b*. In addition, a slide 810 is fixed on the base plate 813 and can be reciprocated by means of a spindle drive 811 when a screw spindle 812 threaded into the side part 20*b* is turned by the spindle drive. A housing 801 extends from the bottom of the base plate 813 and forms part of a coupling device 80 for the cloth beam 51. The coupling device also includes a drive 803 for rotating the cloth beam 51 and a clutch 804 which serves to engage an end of the cloth beam 51 for mounting of the cloth beam 51 in the transporter 102. Coupling of the clutch 804 with the cloth beam 51 is effected by an axial movement of the slide 810 via the spindle drive 811.

As illustrated, a non-rotatable sun wheel 802 is mounted on the housing 801 co-axially of the axis of the cloth beam 51 and clutch 804. In addition, the housing 710 described above is also mounted co-axially of the sun gear 802. In this way, the housing 710 is mounted to be freely rotatable on an extension of the housing 801. A planetary wheel 717 is also rotatably mounted on the housing 710 to mesh with the sun wheel 802. This planetary wheel 717 is driven from the opposite side of the transporter 102 via a shaft 718 by means of a toothed belt drive 719, the drive wheel of which is mounted co-axially of the cloth beam 51 in the side part 20*a*. The rotation of the shaft 718 causes the planetary wheel 717 to roll on the fixed sun wheel 802 so that the housing 710 is caused to pivot about the axis of the cloth beam 51 as explained above.

As illustrated, the lever 711 is arcuate in shape and carries a roller 713. In addition, as the roller 713 runs on the cam segment 714, the corresponding part of the lever 711 moves towards the axis of the cloth beam 51 so that the compression spring 712 is subjected to greater force. The recess 715 on the other side of the lever 711 is pivoted outwardly under these conditions. In this position, the recess 715 can take over the wind-on beam 70 which has been lifted from below. As the lever 711 swings back after insertion of the wind-on beam 70, the recess 715 comes beneath a projection 710' of the housing 710 so that the inserted journal (not shown) of the wind-on beam 70 is locked in place.

As shown in FIG. 4, a manipulator 72 is positioned in the bottom part of the transporter 102 to bring the wind-on beam 70 out of a position of rest in a recess 720' into a 16 position 720 at which the beam 70 can be lifted by the grippers 40*a*, 40*b*. The lifting of the beam 70 from the position 720' to the position 720 by means of a lever arm 721 of the manipulator 72 is effected by switching on of a spindle drive 724 on which a lever arm 723 is articulated and connected to the lever arm 721 via a shaft 722.

A similar manipulator 72 is disposed on the opposite side of the carrier unit.

As also shown in FIG. 4, the mobile unit 1*b* is provided with rollers 154 for rolling on a floor while the portion 20*b* of the carrier unit is provided with plate-like feet 23. In similar fashion, the mobile unit 1*a* and the portion 20*a* are provided with similar components.

Figure 5:
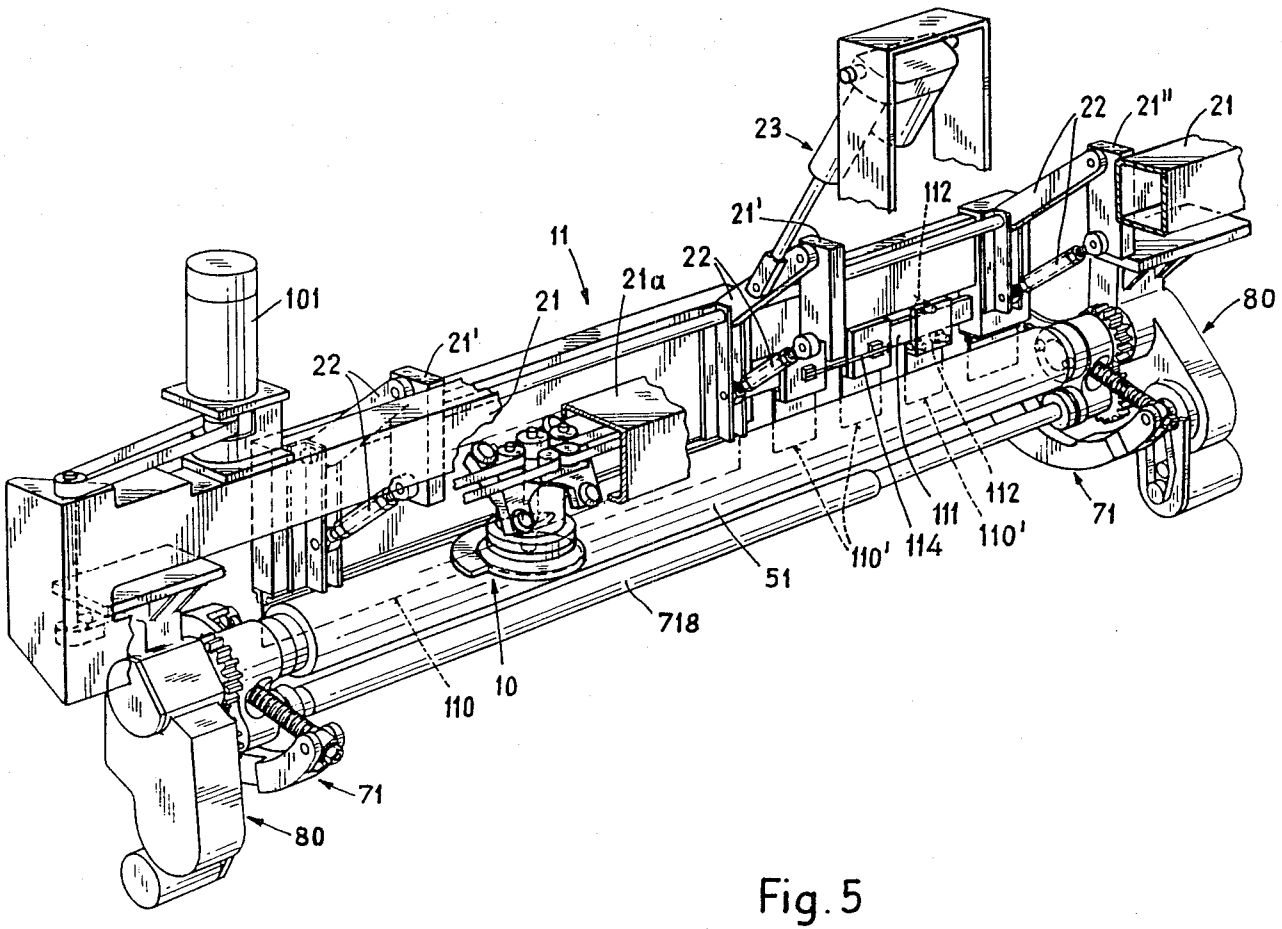
FIG. 5 illustrates a prospective view of a folder late assembly constructed in accordance with the invention.

Referring to FIG. 5, the cloth folder 11 is guided on bearing plates 21' which are secured to the cross-member 21 of the transporter. As indicated, the folder 11 is guided on the plates 21' via parallelogram guides 22 and is moved up and down by a spindle drive 23 articulated to a central guide 22. The folder blade 110 which is in contact with the fabric during the folding operation extends through part of the folder and is divided into segments 110' over the remaining part of the folder. Upon adjustment of the width of the transporter 102 by means of the telescopic rods 225 shown in FIG. 1, the bearing plate 21'' shown on the right, as viewed, together with the associated parallelogram guide 22 is moved longitudinally with respect to the remainder of the folder 11. The blade segments 110' thus come closer together or move farther apart while sliding on a rail 111 via rollers 112. A uniform spacing may be maintained between the individual segments 110 by means of an elastic strip 114 fixed to each segment 110.

Figure 6:
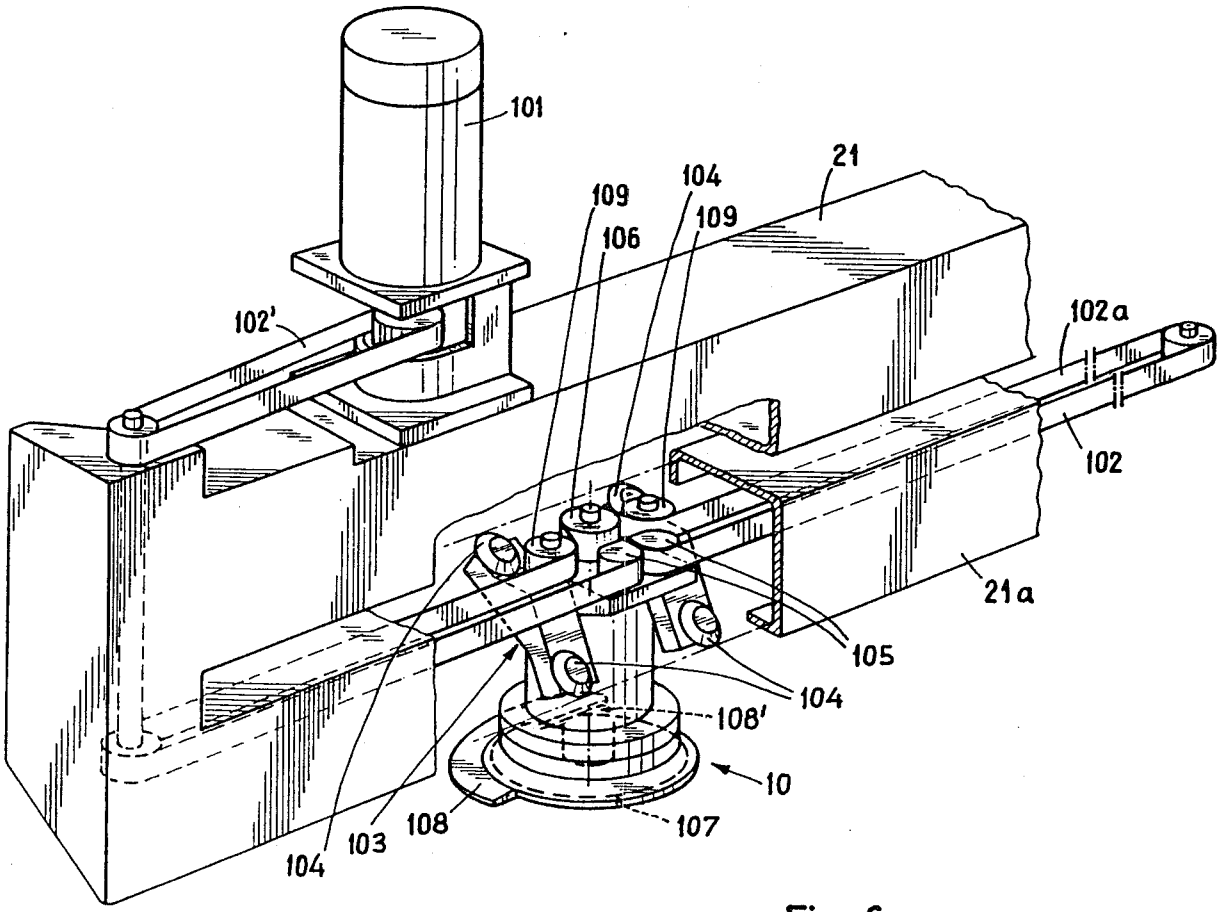
FIG. 6 illustrates a part perspective view of a cutter constructed in accordance with the invention.

Referring to FIG. 6, the cutter 10 is also fixed to the cross-member 21*a*. As indicated, a drive motor drives a belt 102' which, in turn, drives a drive belt 102 which extends over the entire width of the transporter. A cutter slide 103 is guided along the cross-member 21 by means guide rollers 104 while the belt 102 is held fast by clamping rollers 105 in the top part of the slide 103. Upon movement of the belt 102, the slide 103 moves along the cross-member 21.

A pair of deflecting rollers 109 for the rear run 102*a* of the belt 102 and an intermediate drive roller 106 connected via a shaft to a cutter disk 107 so as to rotate therewith are provided behind the clamping rollers 105. A fabric guide 108 extends over part of the periphery of the cutter disk 107.

In operation, the fabric is cut by the cutter slide 103 moving along the cross-member 21*a* while the fabric enters the cutter slide 103 at an inlet opening 108' between the fabric guide 108 and the cutter disk 107.

Figure 7:
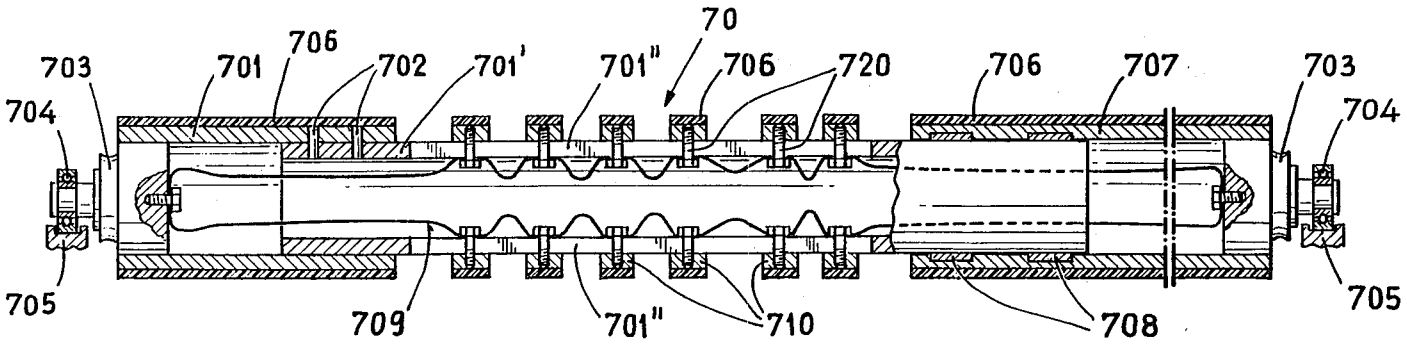
FIG. 7 illustrates a cross-sectional view of a wind-on beam constructed in accordance with the invention.

Referring to FIG. 7, the wind-on beam 70 may be formed of an inner tube 701' within a pair of concentric outer tubes 701, 707 as well as individual tubular segments 710. As indicated, the outer tube 701 is secured to the inner tube 701' by means of pins 702 in fixed relation while the outer tube 707 is slidably mounted on the inner tube 701' via plain bearings 708 The inner tube 701' also has partial longitudinal slots 701'' by means of which the individual tube segments 710 are connected to an elastic strip 709 within the inner tube 701' by means of screw bolts 720. In this way, the length of the wind-on beam 70 can be adjusted to the working width of the weaving machine 500 and a transporter 102. For example, upon actuation of the adjusting device for the width of the transporter, the tube 701' moves relative to the outer tube 707. In this respect, each of the outer tubes 701, 707 is mounted by a collar 703 in a ball bearing 704 supported in a support 705. The collars 703 serve to receive the gripper arms **40*a*, 40*b* (not shown) so that the wind-on beam 70** can be engaged for movement from place to place.

As illustrated, the tubes 701, 707 and tube segments 710 each have a surface coating of elastic plastic material by means of which they periodically bear on the cloth beam 51.

The invention thus provides a relatively simple method of winding fabric onto a cloth beam in a transporter for a weaving mill. Further, the invention provides a relatively simple construction within a transporter for the winding on of a fabric onto a cloth beam by means of a wind-on beam.

The invention further provides a relatively simple apparatus whereby a free portion of the fabric can be brought up to a fresh cloth beam in such a manner that winding on of the fabric after cutting takes place in a reliable manner without any slippage of the fabric on the cloth beam even in the case of smooth fabrics.

What is claimed is:

1. A method of winding fabric onto a cloth beam in a transporter for a weaving mill, said method comprising the steps of placing a free end of the fabric over an empty cloth beam in the direction of rotation thereof during winding;

placing a blade tangentially of the empty cloth beam and ag~~ainst~~ the free end of the fabric to hold the fabric against the cloth beam;

moving a wind-on beam circumferentially about the cloth beam to wrap the cloth about the cloth beam and to position the blade between the beams with the free end of the fabric resting on the wind-on beam; and thereafter rotating the cloth beam to wind the cloth thereon and over the free end of the fabric.

2. A method as set forth in claim 1 wherein the free end of the fabric is folded into the form of a V with the wind-on beam in said position and wherein the folded end of the fabric is subsequently placed tightly between the cloth beam and a first winding of cloth on the cloth beam.

3. In a transporter for a weaving mill, the combination comprising means for mounting an empty cloth beam on a predetermined axis; and at least one manipulator rotatably mounted on said axis and having a recess for receiving one end of a wind-on beam, a sun wheel fixedly mounted on said axis and a driveable planetary wheel meshing with said sun wheel to selectively move the wind-on beam about the cloth beam.

4. The combination as set forth in claim 3 which further comprises a blade for placement tangentially of a mounted cloth beam to fold a free end of a cloth against the cloth beam.

5. The combination as set forth in claim 4 wherein said blade has individual longitudinally spaced segments at least some of said segments being longitudinally movable to adjust to the width of a mounted cloth beam.

6. The combination as set forth in claim 3 which further comprises a wind-on beam of telescopic construction including a first tube, a second tube telescopically receiving a portion of said first tube and having an outside diameter greater than said first tube, and a plurality of tubular segments slidably mounted on said first tube, each segment having an outside diameter equal to said outside diameter of said second tube.

7. The combination as set forth in claim 3 which further comprises a wind-on beam having an elastic plastics coating.

8. In a transporter for a weaving mill, the combination comprising means for mounting an empty cloth beam on a first axis;

a pair of manipulators rotatably mounted on said axis, for receiving a wind-on beam on a second axis spaced from and and parallel to said first axis, said manipulators being rotatable to selectively move the wind-on beam about the cloth beam; and a folder blade for placement tangentially of a mounted cloth beam to fold a free end of a cloth against the clot beam.

9. The combination a set forth in claim 8 wherein said blade has individual longitudinally spaced segments at least some of said segments being longitudinally movable to adjust to the width of a mounted cloth beam.

10. The combination as set forth in claim 8 which further comprises a wind-on beam of telescopic construction including a first tube, a second tube telesopically receiving a portion of said first tube and having a outside diameter greater than said first tube, and a plurality of tubular segments slideably mounted on said first tube, each segment having an outside diameter equal to said outside diameter of said second tube.

11. The combination as set forth in claim 8 which further comprises a cutter for severing a length of cloth extending to a mounted cloth beam.

* * * * *

UNITED STATES PATENT AND TRADEMARK OFFICE

CERTIFICATE OF CORRECTION

PATENT NO. : 4,871,124

DATED : October 3, 1989

INVENTOR(S) : Hugo Schilling

It is certified that error appears in the above-identified patent and that said Letters Patent is hereby corrected as shown below:

Column 1, line 24 "nossles" should be -nozzles-
Column 2, line 56 cancel "late"
Column 3, lines 39 and 40 "reachead" should be -reached-
Column 4, line 56 "3f" should be -3f'-
Column 4, line 57 "110" should be -110,-
Column 6, line 9 "a 16 position" should be -a position-
Column 6, line 47 "means guide" should be -means of guide-
Column 7, line 43 "to position" should be -to a position to position-
Column 8, line 34 "and and" should be -and-
Column 8, line 39 "clot" should be -cloth-
Column 8, line 46 "telesopi-" should be --telescopi- --
Column 8, line 47 "a" (second occurrence) should be -an-

Signed and Sealed this

Twenty-fifth Day of December, 199(

*Attest:*

HARRY F. MANBECK, JR.

*Attesting Officer*

*Commissioner of Patents and Trademarks*